US011105195B2

(12) United States Patent
Hill, III et al.

(10) Patent No.: US 11,105,195 B2
(45) Date of Patent: Aug. 31, 2021

(54) METHOD TO ASSESS SAND SCREEN SYSTEM

(71) Applicant: Halliburton Energy Services, Inc., Houston, TX (US)

(72) Inventors: Freeman Lee Hill, III, Spring, TX (US); Sushovon Singha Roy, Houston, TX (US); Luis Emilio San Martin, Albuquerque, NM (US); Ahmed Elsayed Fouda, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/336,869

(22) PCT Filed: Jul. 13, 2018

(86) PCT No.: PCT/US2018/042127
§ 371 (c)(1),
(2) Date: Mar. 26, 2019

(87) PCT Pub. No.: WO2019/018237
PCT Pub. Date: Jan. 24, 2019

(65) Prior Publication Data

US 2021/0108507 A1 Apr. 15, 2021

Related U.S. Application Data

(60) Provisional application No. 62/533,525, filed on Jul. 17, 2017.

(51) Int. Cl.

| | |
|---|---|
| ***E21B 47/085*** | (2012.01) |
| ***E21B 47/092*** | (2012.01) |
| ***E21B 47/002*** | (2012.01) |

(52) U.S. Cl.
CPC ..... *E21B 47/085* (2020.05); *E21B 47/0025* (2020.05); *E21B 47/092* (2020.05)

(58) Field of Classification Search
CPC .... E21B 47/085; E21B 47/092; E21B 47/002; E21B 47/0025
See application file for complete search history.

(56) References Cited

U.S. PATENT DOCUMENTS

2003/0021922 A1* 1/2003 Bode ..... B01D 39/12 428/34.4
2009/0195244 A1 8/2009 Mouget et al.
(Continued)

FOREIGN PATENT DOCUMENTS

EP 2378058 10/2011
EP 2950038 2/2015
(Continued)

OTHER PUBLICATIONS

ISRWO International Search Report and Written Opinion for PCT/US2018/042127 dated Nov. 7, 2018.

*Primary Examiner* — Giovanna Wright
(74) *Attorney, Agent, or Firm* — John Wustenberg; C. Tumey Law Group PLLC

(57) ABSTRACT

A method and a system for determining metal loss in a layered system. The method may comprise disposing an EM metal loss tool downhole, broadcasting an electromagnetic field from the one or more transmitters of the EM metal loss tool into the layered system, recording the altered electromagnetic field with the one or more receivers, processing the signal with an information handling system, and determining metal loss in the layered system. A system may comprise an EM metal loss tool. The EM electromagnetic metal loss tool may comprise at least one transmitter and at least one receiver. The system may further comprise a conveyance, wherein the conveyance is attached to the electromagnetic
(Continued)

metal loss tool, and an information handling system, wherein the information handling system is configured to process the altered electromagnetic field and determine metal loss in the layered system.

23 Claims, 4 Drawing Sheets

(56) References Cited

U.S. PATENT DOCUMENTS

| | | | | |
|---|---|---|---|---|
| 2015/0204648 | A1* | 7/2015 | Nichols | E21B 47/092 324/229 |
| 2015/0338541 | A1* | 11/2015 | Nichols | G01V 3/26 324/338 |
| 2015/0354344 | A1* | 12/2015 | Draper | E21B 47/113 166/250.08 |
| 2016/0070018 | A1 | 3/2016 | Nichols et al. | |
| 2016/0168975 | A1 | 6/2016 | Donderici et al. | |
| 2017/0176629 | A1* | 6/2017 | Omeragic | G01V 3/28 |
| 2017/0191361 | A1 | 7/2017 | Khalaj Amineh et al. | |
| 2018/0074220 | A1* | 3/2018 | David | G01V 3/26 |

FOREIGN PATENT DOCUMENTS

| | | | |
|---|---|---|---|
| WO | 2017196357 | | 11/2017 |
| WO | 2017196371 | | 11/2017 |
| WO | 2018026362 | A1 | 2/2018 |

* cited by examiner

METHOD TO ASSESS SAND SCREEN SYSTEM

BACKGROUND

For oil and gas exploration and production, a network of wells, installations and other conduits may be established by connecting sections of metal pipe together. For example, a well installation may be completed, in part, by lowering multiple sections of metal pipe (i.e., a casing string) into a wellbore, and cementing the casing string in place. In some well installations, multiple casing strings are employed (e.g., a concentric multi-string arrangement) to allow for different operations related to well completion, production, or enhanced oil recovery (EOR) options.

Metal loss of metal pipes is an ongoing issue. Efforts to mitigate metal loss include use of metal loss-resistant alloys, coatings, treatments, and metal loss transfer, among others. Also, efforts to improve metal loss monitoring are ongoing. For downhole casing strings, various types of metal loss monitoring tools are available. One type of metal loss monitoring tool uses electromagnetic (EM) fields to estimate pipe thickness or other metal loss indicators. As an example, an EM metal loss tool may collect data on pipe thickness to produce an EM metal loss log. The EM metal loss data may be interpreted to determine the condition of production and inter mediate casing strings, tubing, collars, filters, packers, screens, and perforations. When multiple casing strings are employed together, correctly managing metal loss detection, EM metal loss tool operations, and data interpretation may be complex.

BRIEF DESCRIPTION OF THE DRAWINGS

These drawings illustrate certain aspects of some examples of the present disclosure, and should not be used to limit or define the disclosure.

DETAILED DESCRIPTION

This disclosure may generally relate to methods for identifying metal loss within a sand screen with an electromagnetic metal loss tool. Electromagnetic (EM) sensing may provide continuous in situ measurements of parameters related to the integrity of sand screens in cased boreholes. As a result, EM sensing may be used in cased borehole monitoring applications. EM metal loss tools may be configured for multiple concentric pipes (e.g., for one or more) with the first pipe diameter varying (e.g., from about two inches to about seven inches or more). EM metal loss tools may measure eddy currents to determine metal loss and use magnetic cores at the transmitters. The EM metal loss tools may use pulse eddy current (time-domain) and may employ multiple (long, short, and transversal) coils to evaluate multiple types of defects in double pipes. It should be noted that the techniques utilized in time-domain may be utilized in frequency-domain measurements. The EM metal loss tools may operate on a conveyance. EM metal loss tool may include an independent power supply and may store the acquired data on memory. A magnetic core may be used in defect detection of sand screens in multiple concentric pipes.

In EM metal loss tools, the interpretation of the data may be based on differences between responses at two different points within the EM metal loss log, a point representing a nominal section and a point where thickness may be estimated. The response differences may be processed to determine the change in metal thickness within a sand screen.

Figure 1:
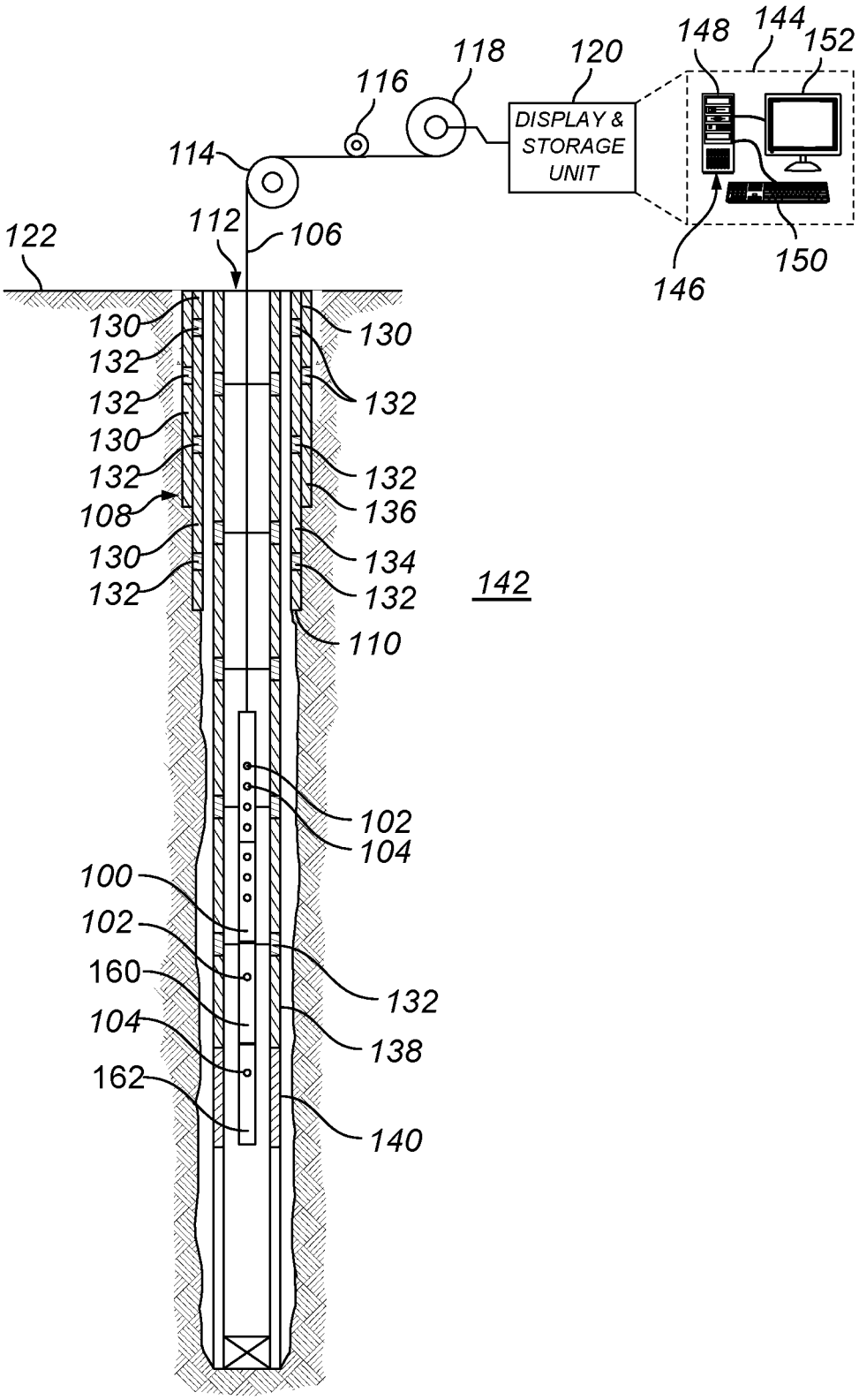
FIG. 1 illustrates a system including an EM metal loss tool.

FIG. 1 illustrates an operating environment for an EM metal loss detection tool 100 as disclosed herein. EM metal loss detection tool 100 may comprise a transmitter 102 and/or a receiver 104. In examples, there may be any number of transmitters 102 and/or any number of receivers 104, which may be disponed on EM metal loss detection tool 100. As illustrated, receivers 104 may be positioned on the EM metal loss detection tool 100 at selected distances (e.g., axial spacing) away from transmitters 102. The axial spacing of receivers 104 from transmitters 102 may vary, for example, from about 0 inches (0 cm) to about 40 inches (101.6 cm) or more. It should be understood that the configuration of EM metal loss detection tool 100 shown on FIG. 1 is merely illustrative and other configurations of EM metal loss detection tool 100 may be used with the present techniques. A spacing of 0 inches (0 cm) may be achieved by collocating coils with different diameters. While FIG. 1 shows only a single array of receivers 104, there may be multiple sensor arrays where the distance between transmitter 102 and receivers 104 in each of the sensor arrays may vary. In addition, EM metal loss detection tool 100 may include more than one transmitter 102 and more or less than six of the receivers 104. In addition, transmitter 102 may be a coil implemented for transmission of magnetic field while also measuring EM fields, in some instances. Where multiple transmitters 102 are used, their operation may be multiplexed or time multiplexed. For example, a single transmitter 102 may broadcast, for example, a multi-frequency signal or a broadband signal in the form of an electromagnetic field. The electromagnetic field may be altered by a downhole formation, which may change the electromagnetic field into an altered electromagnetic field. While not shown, EM metal loss detection tool 100 may include a transmitter 102 and receiver 104 that are in the form of coils or solenoids coaxially positioned within a downhole tubular (e.g., casing string 108) and separated along the tool axis. Alternatively, EM metal loss detection tool 100 may include a transmitter 102 and receiver 104 that are in the form of coils or solenoids coaxially positioned within a downhole tubular (e.g., casing string 108) and collocated along the tool axis.

In additional examples, transmitter 102 may function and/or operate as a receiver 104. EM metal loss detection tool 100 may be operatively coupled to a conveyance 106 (e.g., wireline, slickline, coiled tubing, pipe, downhole tractor, and/or the like) which may provide mechanical suspension, as well as electrical connectivity, for EM metal loss detection tool 100. Conveyance 106 and EM metal loss detection tool 100 may extend within casing string 108 to a desired depth within the wellbore 110. Conveyance 106, which may include one or more electrical conductors, may exit wellhead 112, may pass around pulley 114, may engage odometer 116, and may be reeled onto winch 118, which may be employed to raise and lower the tool assembly in the wellbore 110. Signals recorded by EM metal loss detection tool 100 may be stored on memory and then processed by display and storage unit 120 after recovery of EM metal loss detection tool 100 from wellbore 110. Alternatively, signals recorded by EM metal loss detection tool 100 may be conducted to display and storage unit 120 by way of conveyance 106. Display and storage unit 120 may process the signals, and the information contained therein may be displayed for an operator to observe and stored for future processing and reference. Alternatively, signals may be processed downhole prior to receipt by display and storage unit 120 or both downhole and at surface 122, for example, by display and storage unit 120. Display and storage unit 120 may also contain an apparatus for supplying control signals and power to EM metal loss detection tool 100. Typical casing string 108 may extend from wellhead 112 at or above ground level to a selected depth within a wellbore 110. Casing string 108 may comprise a plurality of joints 130 or segments of casing string 108, each joint 130 being connected to the adjacent segments by a collar 132. There may be any number of layers in casing string 108. For example, a first casing 134 and a second casing 136. It should be noted that there may be any number of casing layers.

FIG. 1 also illustrates a typical pipe string 138, which may be positioned inside of casing string 108 extending part of the distance down wellbore 110. Pipe string 138 may be production tubing, tubing string, casing string, or other pipe disposed within casing string 108. Pipe string 138 may comprise concentric pipes. It should be noted that concentric pipes may be connected by collars 132. EM metal loss detection tool 100 may be dimensioned so that it may be lowered into the wellbore 110 through pipe string 138, thus avoiding the difficulty and expense associated with pulling pipe string 138 out of wellbore 110.

Figure 2:
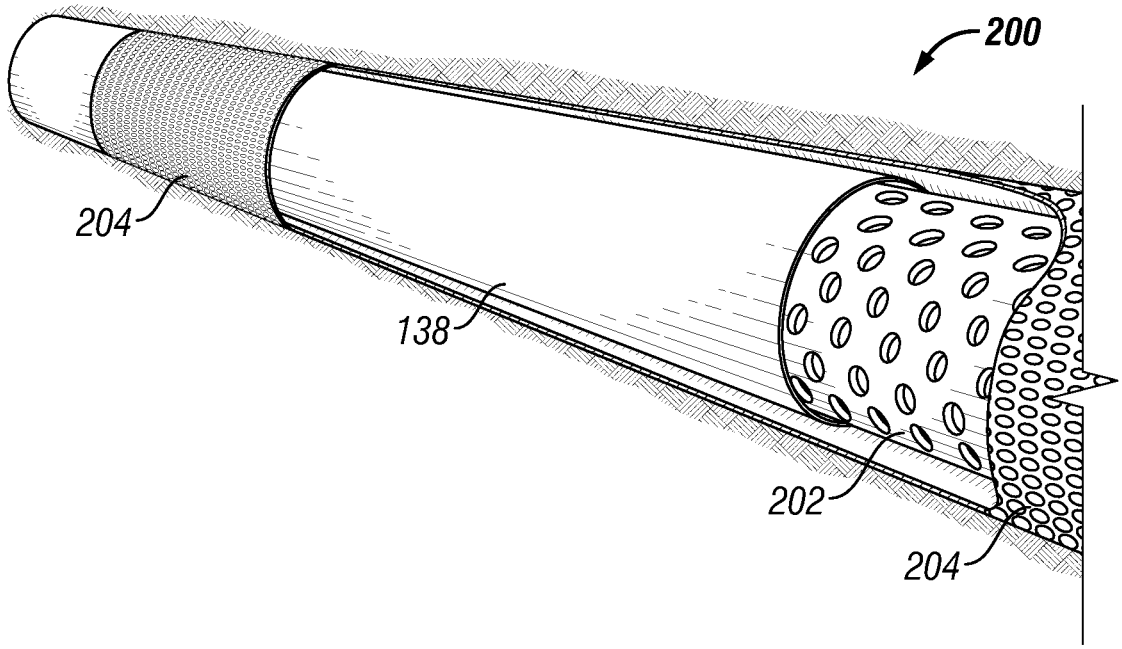
FIG. 2 illustrates a sand control system disposed on a pipe string.

Disposed within pipe string 138 may be sand screen 140. In examples, sand screen 140 may prevent migration of sand to the interior of pipe string 138. As illustrated in FIG. 2, sand control system 200 may comprise at least one perforation 202 disposes in pipe string 138. Screen 204 may cover perforations 202. This may prevent the flow of sand into wellbore 110.

Figure 3:
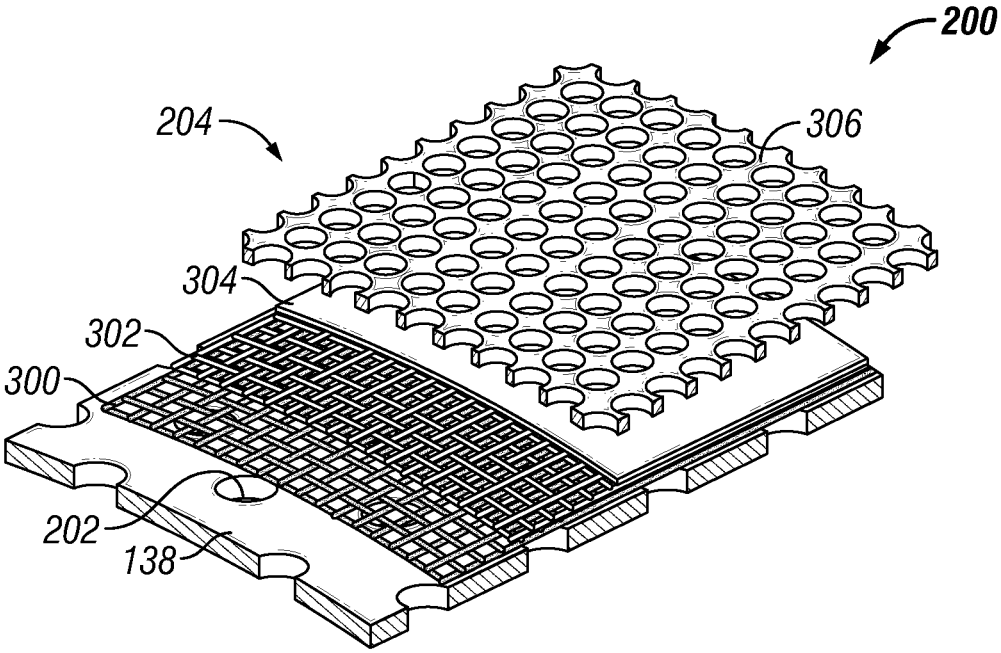
FIG. 3 illustrates a detailed view of the sand control system.

FIG. 3 illustrates a more detailed view of sand control system 200. Perforations 202 within pipe string 138 may be covered by screen 204 which may include a plurality of screen layers. Each layer may be a different material that may be resistant to abrasion and metal loss. Each material may include different electrical properties for electrical conductivity and magnetic permeability. For example, there may be a lower drainage mesh layer 300, support drainage layer 302, and plain Dutch Weave filtration layer 304, all of which may be covered by outer shroud 306.

With continued reference to FIG. 3, the constant flow and harsh downhole environment may erode and corrode the metal alloys that comprise sand control system 200 with the damage generally starting on outer shroud 306 and propagating to the interior of sand control system 200 including pipe string 138. If damage to sand control system 200 is significant, sand migration to the interior of wellbore 110 (e.g., referring to FIG. 1) increases, which may impact the operations within wellbore 110. A method to detect damage to sand control system 200 before severe failure is detected in the system may be performed by EM metal loss detection tool 100 (e.g., referring to FIG. 1). In particular an inspection method that may detect the location and the amount of metal loss due to erosion or metal loss may allow for proper repair of the deficient parts before severe damage occurs.

Referring back to FIG. 1, metal loss detection systems, such as, for example, metal loss systems utilizing the EM metal loss detection tool 100, a digital telemetry system may be employed, wherein an electrical circuit may be used to both supply power to EM metal loss detection tool 100 and to transfer data between display and storage unit 120 and EM metal loss detection tool 100. A DC voltage may be provided to EM metal loss detection tool 100 by a power supply located above ground level, and data may be coupled to the DC power conductor by a baseband current pulse system. Alternatively, EM metal loss detection tool 100 may be powered by batteries located within the downhole tool assembly, and/or the data provided by EM metal loss detection tool 100 may be stored within the downhole tool assembly, rather than transmitted to the surface during metal loss (metal loss detection).

Figure 4:
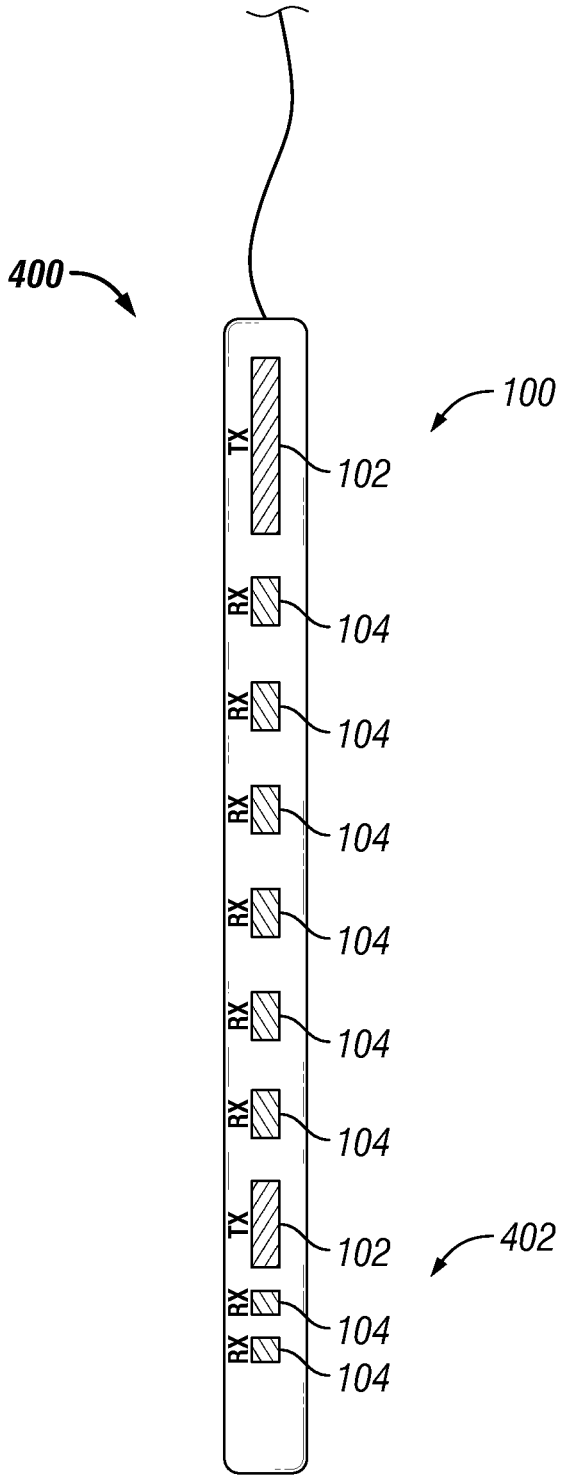
FIG. 4 illustrates the EM metal loss tool with a primary section and a high resolution section.

EM metal loss detection tool 100 may be used for excitation of transmitter 102. As illustrated in FIG. 4, receivers 104 may be positioned on the EM metal loss detection tool 100 at selected distances (e.g., axial spacing) away from transmitters 102. The axial spacing of receivers 104 from transmitters 102 may vary, for example, from about 0 inches (0 cm) to about 40 inches (101.6 cm) or more. It should be understood that the configuration of EM metal loss detection tool 100 shown on FIG. 4 is merely illustrative and other configurations of EM metal loss detection tool 100 may be used with the present techniques. A spacing of 0 inches (0 cm) may be achieved by collocating coils with different diameters. While FIG. 1 shows only a single array of receivers 104, there may be multiple sensor arrays where the distance between transmitter 102 and receivers 104 in each of the sensor arrays may vary.

As illustrated in FIG. 4, EM metal loss detection tool 100 may include more than one transmitter 102 and more or less than six of the receivers 104. For example, metal loss detection tool 100 may comprise a primary section 400 and a high resolution section 402. In examples, transmitter 102 may be a coil implemented for transmission of magnetic field while also measuring EM fields, in some instances. Where multiple transmitters 102 are used, their operation may be multiplexed or time multiplexed. For example, a single transmitter 102 may transmit, for example, a multi-frequency signal or a broadband signal. While not shown, EM metal loss detection tool 100 may include a transmitter 102 and receiver 104 that are in the form of coils or solenoids coaxially positioned within a downhole tubular (e.g., casing string 108) and separated along the tool axis. Alternatively, EM metal loss detection tool 100 may include a transmitter 102 and receiver 104 that are in the form of coils or solenoids coaxially positioned within a downhole tubular (e.g., casing string 108) and collocated along the tool axis.

Primary section 400 and high resolution section 402 may emit electromagnetic energy at multiple programmable frequencies continuously. Each transmitter 102 may emit multiple frequencies simultaneously. The response from sand control system 200 (Referring to FIG. 2) may be received by an array of receivers 104 in primary section 400 and high resolution section 402. EM metal loss detection tool 100 may measures phase and amplitude differences from the electromagnetic energy waves being produced from transmitters 102. Processing the differences may indicate information about any ferrous material in wellbore 110 (Referring to FIG. 1), which may be disposed in completions hardware and/or sand control system 200. High resolution section 402 may be designed to analyze in detail regions closest to the EM metal loss detection tool 100, which may include innermost pipes, for example first casing 134 and second casing 136. The region near EM metal loss detection tool 100 may be where sand control system 200 may be disposed. High resolution section 402 may utilize a relatively higher frequency and the excitation is generated by a relatively shorter transmitter 102 to generate fields in the region closer to the EM metal loss detection tool 100. A higher frequency may range between about 50 Hz to about 1000 Hz while a lower frequency may range between about 0.5 Hz and 50 Hz. The distance between transmitter 102 and receivers 104 may be smaller in high resolution section 402. Receivers 104 disposed close to transmitter 102 may benefit from the use of bucking coils to improve sensitivity to sand control system 200.

Primary section 400 may include a transmitter 102 and an array of receivers 104, but with larger transmitter-receiver spacing. For example, a larger transmitter-receiver spacing may refer to the distance from transmitter 102 to an individual receiver 104, where a plurality of receivers 104 may be disposed in an array. In an array, receivers 104 may be stacked relative to transmitter 102. This may allow an operator to use the different spacing, the distance from transmitter 102 to individual receivers 104 in the array, to have different sensitivities to depth of investigation through formation layers, which may include investigating casings, for example first casing 134 and second casing 136, surrounding the inner completion area. A high resolution array may be used for inner layers, where the distance between receiver 104 to transmitter 102, e.g., spacing, is shorter. A low resolution array may be used for outer layers, where the distance between receiver 104 to transmitter 102 is larger.

In examples, transmitter 102 and receivers 104 may be disposed on the same sub-assembly of EM metal loss detection tool 100 or different sub-assemblies. Without limitation, if transmitter 102 and receiver 104 are disposed on different sub-assemblies, such as sub-assembly 160 and sub-assembly 162, the different sub-assemblies may be separated along EM metal loss detection tool 100 by distance, other sub-assemblies, pipe string, conveyance, and/or the like.

Primary section 400 may measures all outer casings and may focus on deeper field information and may also provide additional information on sand control system 200, although with less resolution. In cases where sand control system 200 may be disposed in a larger diameter pipe string 138 (Referring to FIG. 1), measurements from primary section 400 may be very useful in determining the status of sand control system 200.

Referring back to FIG. 1, transmission of EM fields by the transmitter 102 and the recordation of signals by receivers 104 may be controlled by display and storage unit 120, which may include an information handling system 144. As illustrated, the information handling system 144 may be a component of the display and storage unit 120. Alternatively, the information handling system 144 may be a component of EM metal loss detection tool 100. An information handling system 144 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 144 may be a personal computer, a network storage device, or any other suitable device and may vary in size, shape, performance, functionality, and price. Information handling system 144 may include a processing unit 146 (e.g., microprocessor, central processing unit, etc.) that may process EM log data by executing software or instructions obtained from a non-transitory computer readable media 148 (e.g., optical disks, magnetic disks) that is local. The non-transitory computer readable media 148 may store software or instructions of the methods described herein. Non-transitory computer readable media 148 may include any instrumentality or aggregation of instrumentalities that may retain data and/or instructions for a period of time. Non-transitory computer readable media 148 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing. Information handling system 144 may also include input device(s) 150 (e.g., keyboard, mouse, touchpad, etc.) and output device(s) 152 (e.g., monitor, printer, etc.). The input device(s) 150 and output device(s) 152 provide a user interface that enables an operator to interact with EM metal loss detection tool 100 and/or software executed by processing unit 146. For example, information handling system 144 may enable an operator to select analysis options, view collected log data, view analysis results, and/or perform other tasks.

EM metal loss detection tool 100 may use any suitable EM technique in the frequency domain and/or the time domain. In frequency domain EC techniques, transmitter 102 of EM metal loss detection tool 100 may be fed by a continuous sinusoidal signal, producing primary magnetic fields that illuminate the concentric pipes (e.g., casing string 108 and pipe string 138). The primary electromagnetic fields produce Eddy currents in the concentric pipes. These Eddy currents, in turn, produce secondary electromagnetic fields that may be sensed along with the primary electromagnetic fields by the receivers 104. Characterization of the concentric pipes may be performed by measuring and processing these electromagnetic fields.

In time domain EC techniques, which may also be referred to as pulsed EC ("PEC"), transmitter 102 may be fed by a pulse. Transient primary electromagnetic fields may be produced due the transition of the pulse from "off" to "on" state or from "on" to "off" state (more common). These transient electromagnetic fields produce EC in the concentric pipes (e.g., casing string 108 and pipe string 138). The EC, in turn, produce secondary electromagnetic fields that may be measured by receivers 104 placed at some distance on the EM metal loss detection tool 100 from transmitter 102, as shown on FIG. 1. Alternatively, the secondary electromagnetic fields may be measured by a co-located receiver (not shown) or with transmitter 102 itself.

Figure 5A:
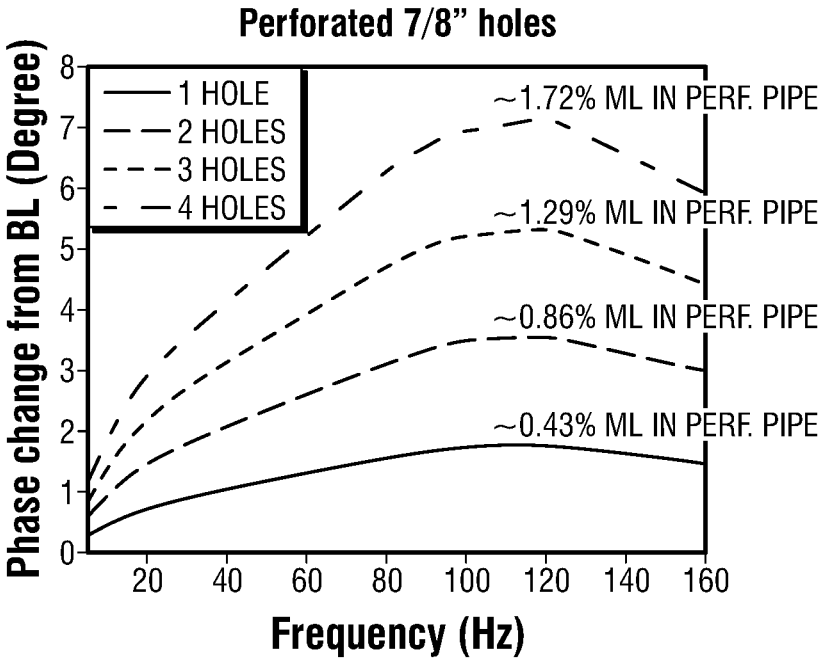
FIG. 5A illustrates a graph of sensitivity versus frequency of perforations.
Figure 5B:
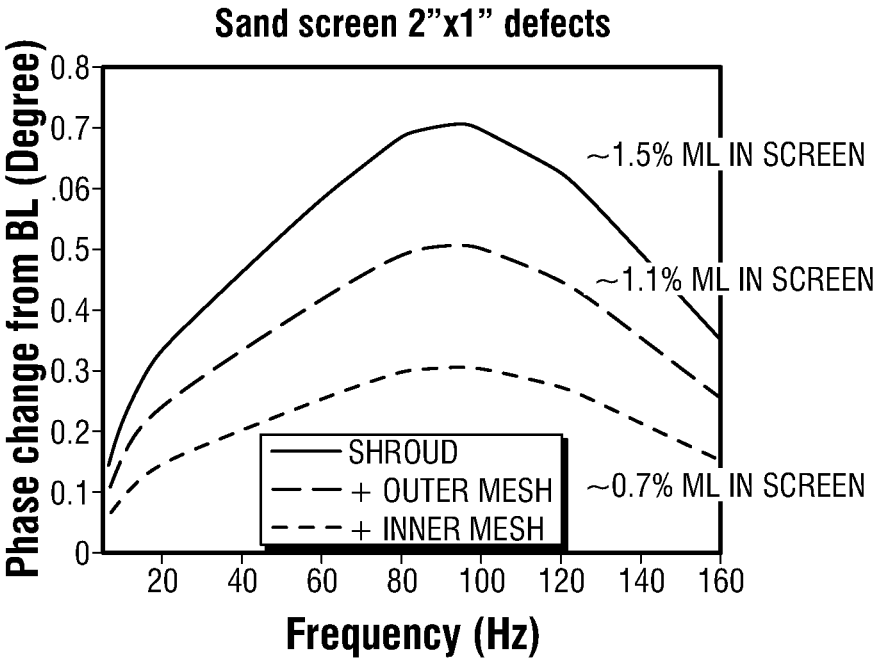
FIG. 5B illustrates a graph of sensitivity versus frequency of a sand screen.

FIGS. 5A and 5B illustrate graphs of sensitivity versus frequency. Sensitivity may be evaluated as the normalized variations of the signal as a function of the frequency. Frequencies selected for use in operation may be based on the optimal sensitivity of for detecting metal loss on sand control system 200. Thus, multiple frequencies may be utilized during operations. Each graph may include the material properties of each of the different layers of sand control system 200. Different processing methods may be used as indicators of metal loss in the different parts of sand control system 200. For example, a mathematical inversion may be utilized to determine the equivalent thicknesses of different parts of sand control system 200. For example, mathematical inversions determine the most likely set of pipe or sand screen parameters (e.g., thickness) by adjusting them until errors between measurement and modeling are minimized. The underlying optimization algorithm may be any one of the numerical optimization algorithms, including but not limited to, the steepest descent, conjugate gradient, Gauss-Newton, Levenberg-Marquardt, and Nelder-Mead. Although the preceding examples are all conventional iterative algorithms, global approaches such as evolutionary and particle-swarm based algorithms may also be used. In examples, the errors may be minimized using a linear search over a search vector rather than a sophisticated iterative or global optimization. The linear search, as mentioned earlier, has the advantage of being readily parallelizable. This advantage may be desirable as it may be cost effective with cloud computing.

Equivalent thicknesses mean the amount of metal that a solid plate may include, which may produce about the identical signal from mesh with holes. The equivalent thicknesses may found by equating the volume of metal of the solid to the volume of metal of the mesh. The equivalent thickness may simplify a forward model. Thus, inversion may determine the thicknesses of a plurality of layers disposed in sand control system 200. The mathematical inversion scheme may determine corrosion of different parts of sand control system 200 from measurements taken by sand control system 200. Different frequencies may be one variable manipulated by EM metal loss detection tool 100 to determine the metal loss at different layers of sand control system 200. These measurements may produce a layered model. The number of measurements taken by EM metal loss detection tool 100 may be enough to solve for all the unknown parameters in the layered model. This layered model may be utilized by the forward model code to solve for EM fields at each layer of sand control system 200. The forward model may be compared with the measurements from EM metal loss detection tool 100 and based on a cost function, which may produce a new model, by repeating the steps iteratively until the cost function is minimized. It should be noted that a deconvolution method may be utilized in place of a method utilizing a mathematical inversion. Inversion schemes and deconvolution schemes may be utilized together to improve resolution of features such as localized metal loss.

By examining the differences between the electromagnetic energy waves coming out of the transmitter and received at the receivers at different spacing, information may be obtained about the metal (ferrous material) in the wellbore. Through forward modeling, using a synthetic reconstruction of the wellbore hardware in software, responses may be predicted. By layering the model and using information from each component, such as the composition of that component, electromagnetic permeability, normal thickness, and more, a great deal of information may be discovered.

Improvements over other techniques and tools may be found through the selection of specified frequencies that may have increased sensitivity to parts of sand control system 200. Preparing a layered schematic in modelling for determining metal loss, which may include utilizing different magnetic permeabilities per layer to improve the layered schematic model. Further examples of improvements may be customizing frequency layouts for each screen component and stacking frequencies simultaneously, taking into consideration eccentering of tubulars, and using bucking coils to obtain satisfactory measurements from near a receiver. From this information and modeling, an operator may be able to determine individual thickness of different layers in sand control system 200.

Additionally, the systems and methods disclosed above use a combination of multiple frequencies and receiver spacings, which may allow for in situ measurements of completion hardware (including gravel pack screens and alike) and material layers in response electromagnetic stimulation. Electromagnetic transmitted frequencies may be selected and optimized to specifically examine different material layers within the completion system. The inversion algorithms may solve for the individual thickness and metal properties per layer. Therefore having the ability to detect damage in each layer examined. This may lead to early detection of problem areas which would lead to failure. It also detects existing gravel pack failures where sand has caused a hole in the metallic screen.

Thus, an operator may be able to determine metal loss, identify a good screen, identify the condition of sand control system 200, identify wear spots, identify inside and outside screen damage, and identify external hardware.

More accurate information may be obtained on the completion or gravel pack screen's condition. It may identify metal loss possibly coming from sand production, therefore location of hole and any damage around hole. This may be important as in some cases the client cannot produce or takes large liability to produce wells while connected in deep water and would prefer not to flow production. This may allow a client to identify issues without flowing.

It should be noted, that this disclosure is not limited to sand control system 200. This disclosure may be applicable to any layered system and/or device disposed in wellbore 110. For example, gavel pack screen, chrome pipe with steel pipe, or a completion that may include different metals, in which the different metals include different permeability and/or thicknesses.

Statement 1: A method for determining metal loss in a layered system may comprise disposing an EM metal loss tool downhole, wherein the EM metal loss tool comprises one or more transmitters and one or more receivers; broadcasting an electromagnetic field from the one or more transmitters of the EM metal loss tool into the layered system, wherein the layered system alters the electromagnetic field into an altered electromagnetic field; recording the altered electromagnetic field with the one or more receivers; processing the signal with an information handling system; and determining metal loss in the layered system.

Statement 2: The method of statement 1, further comprising determining metal loss on another layered system disposed on a second casing, wherein the layered system is disposed on a first casing.

Statement 3: The method of any preceding statements, further comprising performing an inversion to determine an equivalent thickness of a pipe string.

Statement 4: The method of any preceding statements, further comprising estimating the equivalent thickness of the layered system as a ratio between a volume of metal of the pipe string and a volume of metal of the layered system.

Statement 5: The method of any preceding statements, further comprising preparing a layered model for an inversion, wherein a forward model utilizes the layered model to determine electromagnetic fields for at least one layer of the layered model.

Statement 6: The method of any preceding statements, further comprising, comparing the forward model to the altered electromagnetic field.

Statement 7: The method of any preceding statements, wherein the broadcasting the electromagnetic field from the one or more transmitters of the EM metal loss tool comprises a plurality of frequencies.

Statement 8: The method of any preceding statements, further comprising optimizing the plurality of frequencies to enhance sensitivity for a layer of the layered system.

Statement 9: The method of any preceding statements, wherein the layered system is a sand control system comprising one or more screens.

Statement 10: A well measurement system for determining metal loss in a layered system may comprise an EM metal loss tool, wherein the electromagnetic metal loss tool comprises: at least one transmitter, wherein the at least one transmitter is configured to broadcast an electromagnetic field; and at least one receiver, wherein the at least one receiver is configured to record an altered electromagnetic field; and a conveyance, wherein the conveyance is attached to the electromagnetic metal loss tool; and an information handling system, wherein the information handling system is configured to process the altered electromagnetic field and determine metal loss in the layered system.

Statement 11: The well measurement system of statement 10, wherein the electromagnetic metal loss tool comprises a primary section and a high resolution section.

Statement 12: The well measurement system of statements 10 or 11, wherein the information handling system is configured to prepare a layered model for an inversion, wherein a forward model utilizes the layered model to determine the altered electromagnetic field for the layered model.

Statement 13: The well measurement system of statements 10 to 12, wherein the information handling system is configured to compare the forward model to the recorded altered electromagnetic field to form a new model based on a cost function.

Statement 14: The well measurement system of statements 10 to 13, wherein the information handling system is configured to repeat the compare the forward model to the recording the altered electromagnetic field until the cost function is minimized.

Statement 15: The well measurement system of statements 10 to 14, wherein the broadcast the signal with the transmitter comprises a plurality of frequencies.

Statement 16: The well measurement system of statements 10 to 15, wherein the information handling system is configured to identify a frequency sensitive for each layer of the layered system.

Statement 17: The well measurement system of statements 10 to 16, wherein the at least one receiver is disposed on a first sub-assembly and the transmitter is disposed on a second sub-assembly.

Statement 18: The well measurement system of statements 10 to 17, wherein a third sub-assembly is disposed between the first sub-assembly and the second sub-assembly.

Statement 19: The well measurement system of statements 10 to 18, wherein the layered system includes a plurality of perforations, a lower drainage mesh layer, a support drainage layer, and an outer shroud.

Statement 20: The well measurement system of statements 10 to 19, wherein the at least one transmitter emits a plurality of frequencies.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A method for determining metal loss in a layered system, comprising:

disposing an EM metal loss tool downhole, wherein the EM metal loss tool comprises one or more transmitters and one or more receivers;

broadcasting an electromagnetic field from the one or more transmitters of the EM metal loss tool into the layered system which alters the electromagnetic field into an altered electromagnetic field and wherein the layered system is disposed on a pipe string that is at least partially disposed in a casing string and each layer of the layered system has at least one perforation;

recording the altered electromagnetic field with the one or more receivers;

processing the signal with an information handling system;

preparing a layered model of the layered system that includes one or more magnetic permeabilities for each layer in the layered system ; and determining metal loss in the layered system based at least on the layered model.

2. The method of claim 1, further comprising determining metal loss on another layered system disposed on a second casing, wherein the layered system is disposed on a first casing.

3. The method of claim 1, further comprising performing an inversion to determine an equivalent thickness of the pipe string.

4. The method of claim 3, further comprising estimating the equivalent thickness of the layered system as a ratio between a volume of metal of the pipe string and a volume of metal of the layered system.

5. The method of claim 1, wherein a forward model utilizes the layered model to determine electromagnetic fields for at least one layer of the layered model.

6. The method of claim 5, further comprising comparing the forward model to the altered electromagnetic field.

7. The method of claim 1, wherein the broadcasting the electromagnetic field from the one or more transmitters of the EM metal loss tool comprises a plurality of frequencies.

8. The method of claim 7, further comprising optimizing the plurality of frequencies to enhance sensitivity for a layer of the layered system.

9. The method of claim 1, wherein the layered system is a sand control system comprising one or more screens.

10. A well measurement system for determining metal loss comprising:

an EM metal loss tool, wherein the electromagnetic metal loss tool comprises:

at least one transmitter, wherein the at least one transmitter is configured to broadcast an electromagnetic field; and at least one receiver, wherein the at least one receiver is configured to record an altered electromagnetic field; and a conveyance, wherein the conveyance is attached to the electromagnetic metal loss tool;

a layered system disposed on a pipe string that is at least partially disposed in a casing string and each layer of the layered system has at least one perforation; and an information handling system, wherein the information handling system is configured to:

process the altered electromagnetic field;

prepare a layered model of the layered system that includes one or more magnetic permeabilities for each layer in the layered system; and determine metal loss in the layered system based at least on the layered model.

11. The well measurement system of claim 10, wherein the electromagnetic metal loss tool comprises a primary section and a high resolution section.

12. The well measurement system of claim 10, wherein a forward model utilizes the layered model to determine the altered electromagnetic field for the layered model.

13. The well measurement system of claim 12, wherein the information handling system is configured to compare the forward model to the recorded altered electromagnetic field to form a new model based on a cost function.

14. The well measurement system of claim 13, wherein the information handling system is configured to repeat the compare the forward model to the recording the altered electromagnetic field until the cost function is minimized.

15. The well measurement system of claim 10, wherein the transmitter broadcasts the electromagnetic field at a plurality of frequencies.

16. The well measurement system of claim 15, wherein the information handling system is configured to identify a frequency sensitive for each layer of the layered system.

17. The well measurement system of claim 10, wherein the at least one receiver is disposed on a first sub-assembly and the transmitter is disposed on a second sub-assembly.

18. The well measurement system of claim 17, wherein a third sub-assembly is disposed between the first sub-assembly and the second sub-assembly.

19. The well measurement system of claim 10, wherein the layered system includes a lower drainage mesh layer, a support drainage layer, and an outer shroud.

20. The well measurement system of claim 10, wherein the at least one transmitter emits a plurality of frequencies.

21. A method for determining metal loss in a layered system, comprising:

disposing an EM metal loss tool downhole, wherein the EM metal loss tool comprises one or more transmitters and one or more receivers;

broadcasting an electromagnetic field from the one or more transmitters of the EM metal loss tool into the layered system, wherein the layered system alters the electromagnetic field into an altered electromagnetic field;

recording the altered electromagnetic field with the one or more receivers;

processing the signal with an information handling system;

performing an inversion to determine an equivalent thickness of a pipe string;

estimating the equivalent thickness of the layered system as a ratio between a volume of metal of the pipe string and a volume of metal of the layered system; and determining metal loss in the layered system.

22. A method for determining metal loss in a layered system, comprising:

disposing an EM metal loss tool downhole, wherein the EM metal loss tool comprises one or more transmitters and one or more receivers;

broadcasting an electromagnetic field from the one or more transmitters of the EM metal loss tool into the layered system, wherein the layered system alters the electromagnetic field into an altered electromagnetic field;

recording the altered electromagnetic field with the one or more receivers;

processing the signal with an information handling system;

preparing a layered model for an inversion, wherein a forward model utilizes the layered model to determine electromagnetic fields for at least one layer of the layered model;

comparing the forward model to the altered electromagnetic field; and determining metal loss in the layered system.

23. A well measurement system for determining metal loss in a layered system, comprising:

an EM metal loss tool, wherein the electromagnetic metal loss tool comprises:

at least one transmitter, wherein the at least one transmitter is configured to broadcast an electromagnetic field; and at least one receiver, wherein the at least one receiver is configured to record an altered electromagnetic field; and a conveyance, wherein the conveyance is attached to the electromagnetic metal loss tool; and an information handling system, wherein the information handling system is configured to:

process the altered electromagnetic field wherein a forward model utilizes the layered model to determine the altered electromagnetic field for the layered model;

compare the forward model to the recorded altered electromagnetic field to form a new model based on a cost function;

repeat the compare the forward model to the recording the altered electromagnetic field until the cost function is minimized; and determine metal loss in the layered system.

* * * * *